US010954113B2

(12) United States Patent
Sakai et al.

(10) Patent No.: US 10,954,113 B2
(45) Date of Patent: Mar. 23, 2021

(54) DISCHARGE PUMP AND LIQUID DISPENSER

(71) Applicant: SUNTORY HOLDINGS LIMITED, Osaka (JP)

(72) Inventors: Yasufumi Sakai, Tokyo (JP); Yuji Suzuki, Kanagawa (JP); Masatoshi Aihara, Tokyo (JP); Hiroki Yokoyama, Tokyo (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 45 days.

(21) Appl. No.: 16/345,573

(22) PCT Filed: Oct. 20, 2017

(86) PCT No.: PCT/JP2017/038056
§ 371 (c)(1),
(2) Date: Apr. 26, 2019

(87) PCT Pub. No.: WO2018/079451
PCT Pub. Date: May 3, 2018

(65) Prior Publication Data

US 2020/0055719 A1 Feb. 20, 2020

(30) Foreign Application Priority Data

Oct. 26, 2016 (JP) ..... JP2016-209616

(51) Int. Cl.
*B67D 1/08* (2006.01)
*B67D 1/10* (2006.01)
(Continued)

(52) U.S. Cl.
CPC ..... *B67D 1/0801* (2013.01); *B67D 1/108* (2013.01); *B67D 1/0057* (2013.01);
(Continued)

(58) Field of Classification Search
CPC .... B67D 1/0001; B67D 1/0801; B67D 1/108; B67D 2001/082–0821; B67D 2001/0827;
(Continued)

(56) References Cited

U.S. PATENT DOCUMENTS 3,582,234 A 6/1971 Isreeli et al.
3,750,908 A * 8/1973 Bauerlein ..... B67D 1/0079 222/80
(Continued)

FOREIGN PATENT DOCUMENTS

EP 0201389 A1 12/1986
FR 2789736 A1 8/2000
(Continued)

OTHER PUBLICATIONS

International Search Report issued in Application No. PCT/JP2017/038056, dated Dec. 12, 2017.
(Continued)

*Primary Examiner* — Patrick M. Buechner
*Assistant Examiner* — Randall A Gruby
(74) *Attorney, Agent, or Firm* — Michael Best & Friedrich LLP

(57) ABSTRACT

A flexible container (80) includes a reservoir part (82) that reserves a liquid and a discharge passage part (81) that communicates with the reservoir part (82) to take out the liquid. A discharge pump includes a plurality of roller parts (50) that press the discharge passage part (81) and an endless transfer mechanism unit (60) that has the plurality of roller parts (50) attached at a predetermined interval and causes the roller parts (50) to go around. The endless transfer mechanism unit (60) has an arrangement including a straight-line portion in which the roller parts (50) linearly move, in a path of the go-around movement. An attachment interval of the plurality of roller parts (50) is set to such an
(Continued)

interval that before a certain roller part (50) going around reaches a position where the certain roller part (50) does not press the discharge passage part (81), a subsequent roller part (50) is able to reach a position where the subsequent roller part (50) presses the discharge passage part (81). Each of the roller parts (50) linearly moves sequentially in a discharge direction of the liquid with respect to the discharge passage part (81) while pressing the discharge passage part (81).

5 Claims, 16 Drawing Sheets

(51) Int. Cl.
*B67D 1/00* (2006.01)
*F04B 43/12* (2006.01)

(52) U.S. Cl.
CPC ..... *B67D 2001/082* (2013.01); *B67D 2001/0827* (2013.01); *F04B 43/1253* (2013.01)

(58) Field of Classification Search
CPC ..... F04B 43/12; F04B 43/082; F04B 43/1253–1292
USPC ..... 222/214; 417/477.9, 477.14
See application file for complete search history.

(56) References Cited

U.S. PATENT DOCUMENTS 5,353,963 A * 10/1994 Gorski ..... B67D 1/0021 222/129.1
5,875,930 A * 3/1999 Nakajima ..... B67D 1/0039 222/129.1
6,253,968 B1 * 7/2001 Van Dijk ..... G01F 11/088 222/181.2
6,769,231 B2 * 8/2004 Danby ..... A21B 7/00 222/105
6,871,015 B2 * 3/2005 Gutierrez ..... B67D 1/0004 222/146.1
6,938,801 B1 * 9/2005 Reddy ..... B67D 1/0007 222/132
7,661,352 B2 * 2/2010 Sher ..... B67D 1/0021 99/275
8,740,019 B1 * 6/2014 Ciavarella ..... A47K 5/16 222/214
9,511,987 B2 * 12/2016 Hayakawa ..... B67D 1/0028
10,518,938 B2 * 12/2019 Suzuki ..... B65D 35/28
2002/0179642 A1 * 12/2002 Gutierrez ..... B67D 3/0029 222/146.1
2003/0089740 A1 * 5/2003 Gutierrez ..... B67D 1/0004 222/146.5
2007/0068966 A1 * 3/2007 Orzech ..... B67D 1/108 222/136
2007/0068969 A1 * 3/2007 Orzech ..... F04B 43/082 222/214
2017/0015541 A1 * 1/2017 Vulpitta ..... B67D 1/0001
2018/0079559 A1 3/2018 Suzuki et al.

FOREIGN PATENT DOCUMENTS

GB 2425523 A 11/2006
JP H07-330092 A 12/1995
JP H09-264256 A 10/1997
JP 2016-175701 A 10/2016
WO WO-2016/148203 A1 9/2016
WO WO-2016/148220 A1 9/2016

OTHER PUBLICATIONS

The Extended European Search Report issued in Application 17866026.2, dated May 12, 2020.

* cited by examiner

DISCHARGE PUMP AND LIQUID DISPENSER

TECHNICAL FIELD

The present invention relates to a discharge pump that discharges a predetermined amount of liquid from a flexible container containing a liquid into another container, and the like.

BACKGROUND ART

As a conventional beverage supply device of a cup dispenser type, which provides a liquid beverage such as coffee or juice by pouring the liquid beverage into a container such as a paper cup, it is common to adopt a so-called bag-in-box (BIB) system. In the BIB system, a raw material liquid (concentrated liquid) of a beverage is filled and sealed in a bag-shaped container (bag) formed of a deformable material such as a soft synthetic resin. This container is stored in a paper-made box such as a cardboard box to make it possible to handle the container together with the box. The raw material liquid is supplied by a proper amount from the container in the box attached to a supply device. When all of the raw material liquid is taken out from the container, the container is exchanged together with the box.

In such a beverage supply device, when a raw material liquid containing water and nutrients comes in contact with a component itself of the device, there is a possibility that germs or the like may propagate and it may reach a state of being unsanitary. Therefore, in many cases, a sterile container with a thin tube making elastic deformation as a passage for taking out a liquid is used and a tube pump capable of pumping the liquid in the tube in a non-contact manner with the outside air is adopted.

In this case, the conventional beverage supply device has a plurality of tube pumps installed, for each type of containers filled with raw material liquids, below a storage space that stores a box containing the containers. Under these tube pumps, drinking containers such as paper cups are placed. Then, the box containing the containers is stored in the storage space of the beverage supply device, and tubes integrally provided in the containers are respectively drawn out from the bottom of the box and attached to the respective tube pumps, and each tip of the tubes is put into a state of being positioned above the drinking containers.

In use, the beverage supply device operates, when receiving a command to supply a designated beverage by a user's operation, a corresponding tube pump to discharge a proper amount of raw material liquid through the tube to a drinking container positioned therebelow. At the same time, such a mechanism is made that a proper amount of water, carbonated water or the like for diluting the raw material liquid is separately supplied and discharged into the drinking container to provide a beverage diluted at a predetermined ratio.

In particular, with regard to a configuration for discharging a liquid, Patent Literature 1 discloses an example of a technique for discharging a liquid in a tube using a caterpillar pump. The technique disclosed in Patent Literature 1 is such that: a plurality of rotation rollers 8 are mounted on an endless transfer member 12 to be moved around on an orbit including a linear portion, causing the rotation rollers 8 to move linearly while pressing the side of a discharge tube 3; an openable and closeable guide 17 for holding the discharge tube 3 with the rotation rollers 8 is provided on one side opposed to the rotation rollers 8 to make the rotation rollers 8 press the discharge tube 3; the rotation rollers 8 are made to run approximately in parallel to the guide 17 in a state where the discharge tube 3 is pressed, by a guide part 19 provided opposed to the linear orbit portion of the transfer member 12; and holding recesses are formed in the rotation rollers 8 to restrict the movement of the discharge tube 3 in an axial direction of the rotation roller 8.

CITATION LIST

Patent Literature

Patent Literature 1: Japanese Unexamined Patent Application Publication No. 7-330092

SUMMARY OF INVENTION

Technical Problem

However, in the technique disclosed in Patent Literature 1, it is necessary to connect and dispose a tube made of an elastic material of another material in order to withstand the pressure of the rotation rollers, which increases the manufacturing cost of the container.

Further, it is necessary to attach the tube so as not to move easily with respect to the tube pump in order to properly discharge a raw material liquid, and it is also necessary to attach and detach the tube of the container to and from the tube pump every time the container is replaced. Therefore, there is a problem that it takes time to handle the tube and the container cannot be easily exchanged for each box.

The present invention has been made to solve the above problem and it is an object of the present invention to provide a discharge pump capable of reliably pressing a discharge passage part, which is an extended portion formed as a part of a flexible container, to discharge a proper amount of liquid, by pressing the discharge passage part with a roller to control a discharge amount, and a liquid dispenser therewith.

Solution to Problem

A discharge pump according to the present invention is a discharge pump for discharging a liquid from a flexible container in which the liquid is sealed, wherein the flexible container includes a reservoir part that reserves the liquid and a discharge passage part that communicates with the reservoir part to take out the liquid, the discharge pump including: a plurality of roller parts that press the discharge passage part; and an endless transfer mechanism unit that has the plurality of roller parts attached at a predetermined interval and moves the roller parts to cause the roller parts to go around, wherein the endless transfer mechanism unit has an arrangement including a straight-line portion in which the roller parts linearly move, in a path of the go-around movement, an attachment interval of the plurality of roller parts is set to such an interval that before a certain roller part going around reaches a position where the certain roller part does not press the discharge passage part, a subsequent roller part is able to reach a position where the subsequent roller part presses the discharge passage part, and each of the roller parts linearly moves sequentially in a discharge direction of the liquid with respect to the discharge passage part while pressing the discharge passage part.

As described above, according to the present invention, in order to discharge the content from the flexible container, the discharge passage part of the flexible container is pressed by the roller parts while the plurality of roller parts are linearly moved with the endless transfer mechanism unit, to put the discharge passage part expanded with an inflow of the content into a state of being sequentially squeezed by the roller parts, so that the content in the discharge passage part is advanced little by little toward an opening of a discharge passage part end in accordance with the linear movement of the roller parts and is finally sent out from the discharge passage part end, thereby making it possible to discharge the content through the discharge passage part, which results in that it is possible to discharge the content with a simple mechanism. Further, the content in the range other than that from the discharge passage part end to a position pressed by the roller part cannot go out, so that it is possible to discharge a proper amount of content by adjusting a state of movement of the roller parts. Furthermore, in a case where the discharge passage part is constantly pressed by any of the roller parts to bring side wall surfaces forming the discharge passage part into close contact with each other, an occluded state in which outside air and the content are not brought into contact with each other is obtained without another mechanism and it is possible to secure a sanitary condition of the discharge passage part.

In addition, the content can be taken out by forming a part of the flexible container as the discharge passage part, so that it is not necessary to additionally provide the flexible container with a passage part for taking out a content such as a tube made of a different material and cost reduction can be also realized for containers as much as the structure of the container can be simplified.

The discharge pump according to the present invention is, when needed, such that the flexible container is formed by sticking two sheets to each other with one side of the respective sheets extended in an elongated shape, and the discharge passage part is comprised of the elongated extended part.

As described above, according to the present invention, the flexible container is formed by sticking two sheets to each other with one side of the respective sheets extended in an elongated shape, and the discharge passage part is comprised of the elongated extended part, so that there is no such an incident that it cannot withstand a pressing force and is damaged when pressed by rotation rollers as in the case of the discharge tube, resulting in that it is possible to stably supply a liquid.

Further, the discharge pump according to the present invention, when needed, further includes: a guide part that guides the go-around movement of the roller parts; a belt part that is disposed on both sides of the guide part to be bilaterally symmetrical and to be in a state capable of circulating in the same direction as a guide direction of the guide part; and a support that is supported on a surface of the belt part such that the roller parts are perpendicular to the guide direction and go around along a surface of the guide part.

As described above, according to the present invention, it is further provided with: a guide part that guides the go-around movement of the roller parts; a belt part that is disposed on both sides of the guide part to be bilaterally symmetrical and to be in a state capable of circulating in the same direction as a guide direction of the guide part; and a support that is supported on a surface of the belt part such that the roller parts are perpendicular to the guide direction and go around along a surface of the guide part, so that the roller parts are disposed on the surface side of the belt part by the support and go around along the surface of the guide part, resulting in that it is possible to increase a dimension of each roller part and a degree of freedom in layout.

Further, a liquid dispenser according to the present invention is a liquid dispenser that discharges a liquid from a flexible container in which the liquid is sealed, by the discharge pump, including a pressure receiving part that is disposed on an opposite side of the flexible container from the discharge pump.

As described above, according to the present invention, there is provided a pressure receiving part that is disposed on an opposite side of the flexible container from the discharge pump, so that it is possible to press the flexible container with a sufficient pressing force to discharge a liquid in the discharge passage part. Further, it is possible to constantly press the discharge passage part against the pressure receiving part by any of the roller parts, so that, by bringing side wall surfaces of the discharge passage part into close contact with each other, an occluded state in which outside air and the content are not brought into contact with each other is obtained and it is possible to secure a sanitary condition of the discharge passage part.

Further, the liquid dispenser according to the present invention, when needed, further includes a container storage part that stores the flexible container, the container storage part being stored in the liquid dispenser, wherein the pressure receiving part and the discharge pump are provided below the container storage part, and a total dimension of the pressure receiving part and the discharge pump in a pressing direction is smaller than a width of the container storage part.

As described above, according to the present invention, it is further provided with a container storage part that stores the flexible container, the container storage part is stored in the liquid dispenser, the pressure receiving part and the discharge pump are provided below the container storage part, and a total dimension of the pressure receiving part and the discharge pump in a pressing direction is smaller than a width of the container storage part, so that in a case where a plurality of container storage parts are stored side by side in a storage shelf, it is possible to store the plurality of container storage parts in the storage shelf side by side without difficulty by arranging the pressure receiving part and the discharge pump so as not to contact with those of another container storage part adjacent to each other.

Further, the liquid dispenser according to the present invention, when needed, further includes a connection mechanism that connects the pressure receiving part and the discharge pump.

As described above, according to the present invention, it is further provided with a connection mechanism that connects the pressure receiving part and the discharge pump, so that it is possible to properly press by the roller parts the flexible container held between the pressure receiving part and the roller parts.

Further, the liquid dispenser according to the present invention, when needed, further includes an elastic body that has an elastic force opposite to a pressing force in the pressing direction on a rear surface side of the pressure receiving part.

As described above, according to the present invention, it is further provided with an elastic body that has an elastic force opposite to a pressing force in the pressing direction on a rear surface side of the pressure receiving part, so that it is possible to make the pressing force of the roller parts uniform by the elastic force of the elastic body even in a case where the roller parts do not equally press the pressure receiving part and a bias has occurred therein.

DESCRIPTION OF EMBODIMENTS

First Embodiment of the Present Invention

Figure 1:
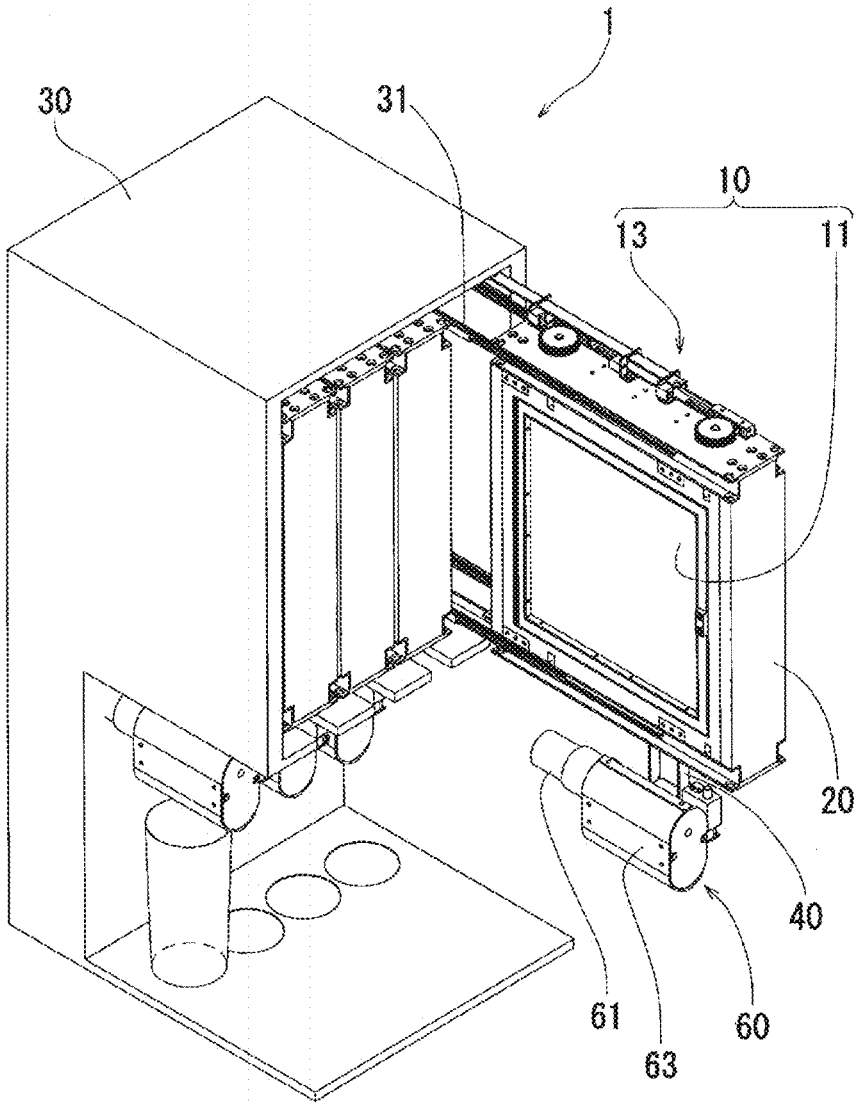
FIG. 1 is a perspective view for illustrating a state in which a support frame is pulled out, of a discharge device according to a first embodiment of the present invention.
Figure 2:
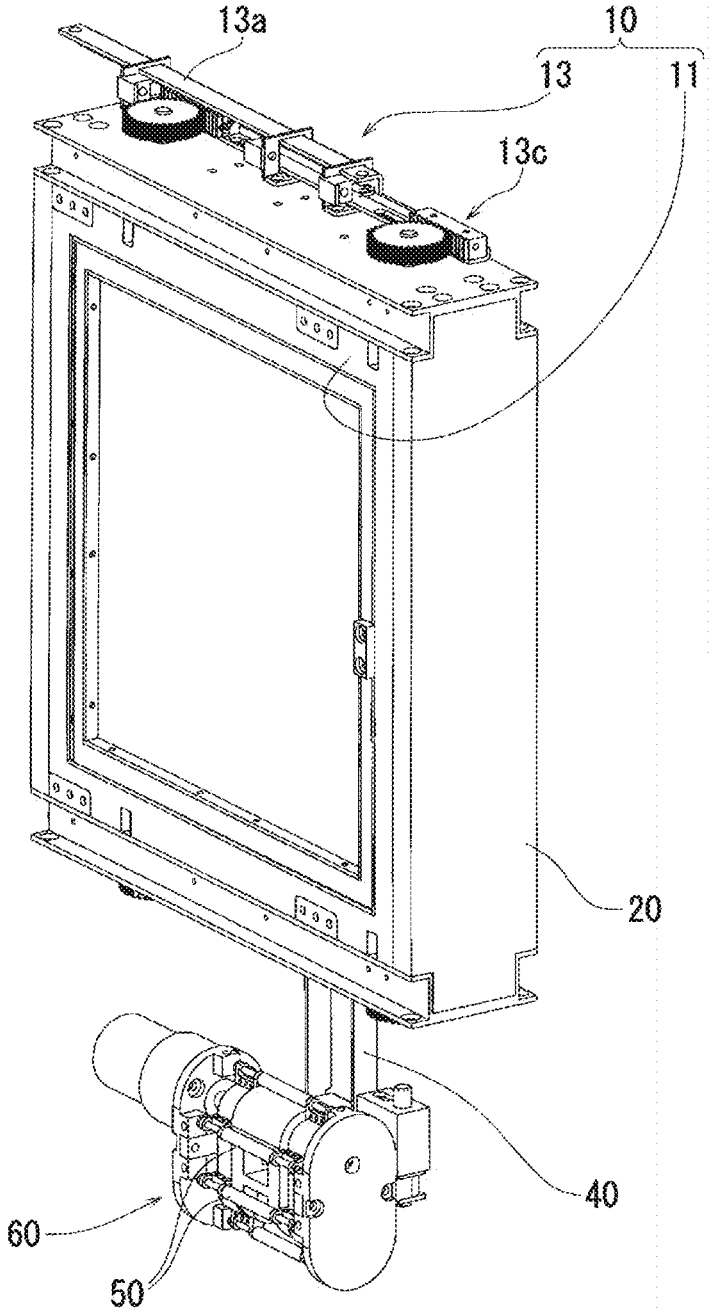
FIG. 2 is a perspective view of main parts of the discharge device according to the first embodiment of the present invention.
Figure 3:
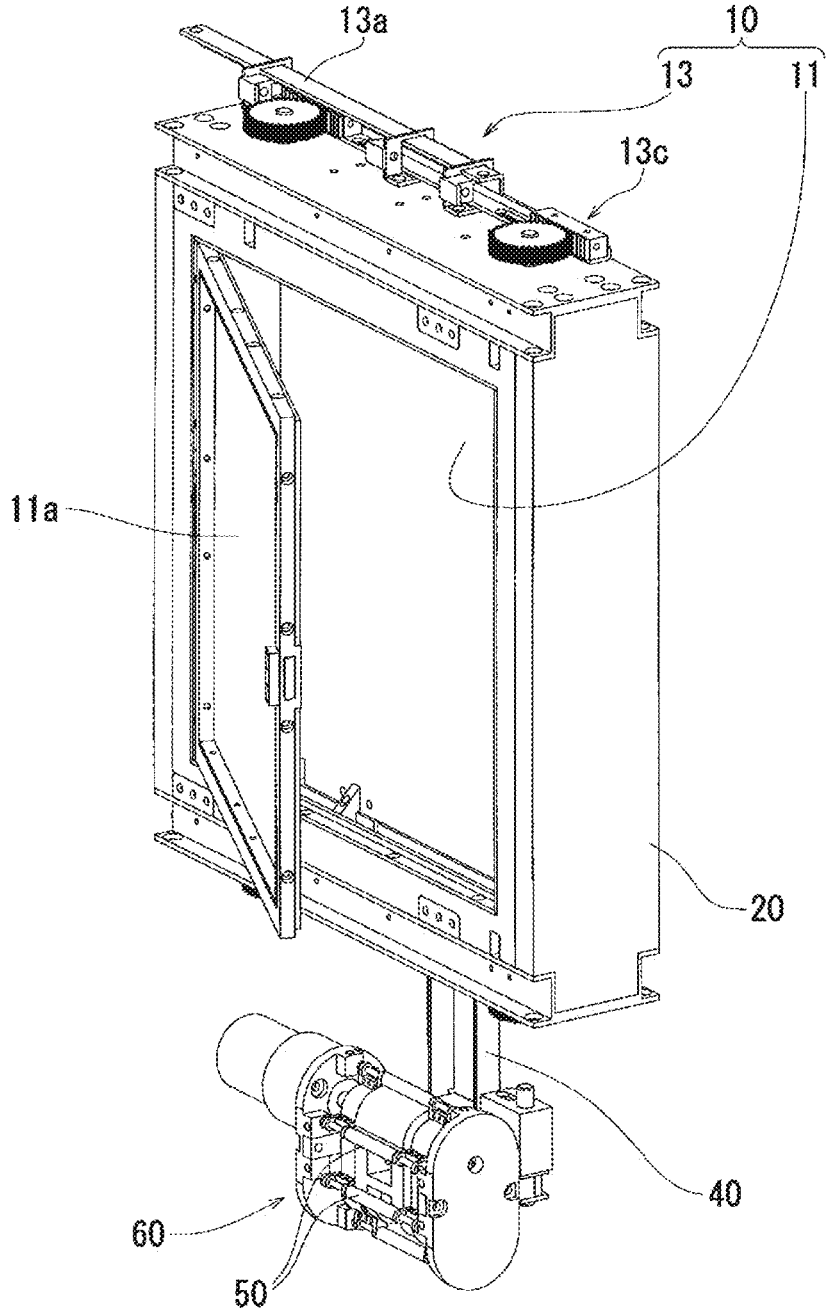
FIG. 3 is a perspective view for illustrating a state in which a door part of a pressing part is opened in the discharge device according to the first embodiment of the present invention.
Figure 4:
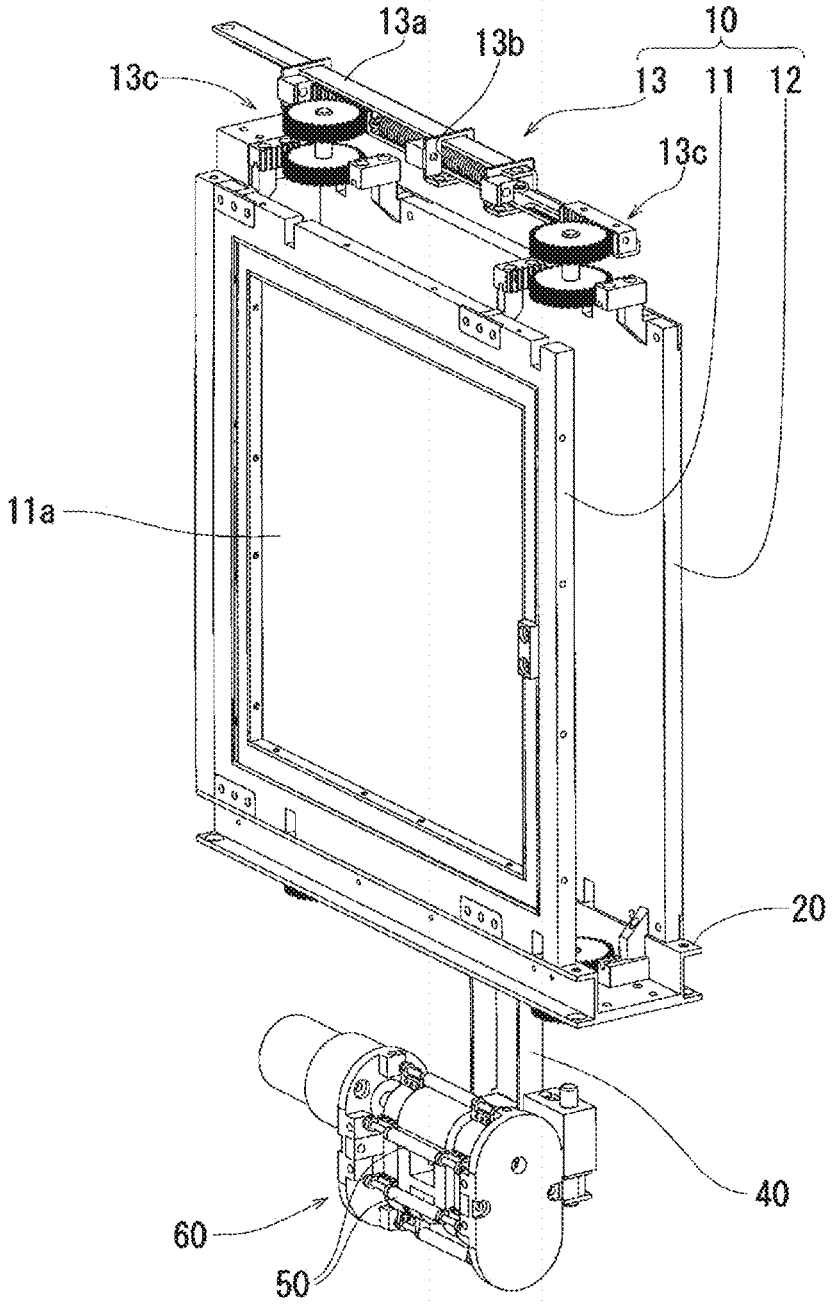
FIG. 4 is a perspective view for illustrating a state in which pressing parts separate from each other in the discharge device according to the first embodiment of the present invention.
Figure 5:
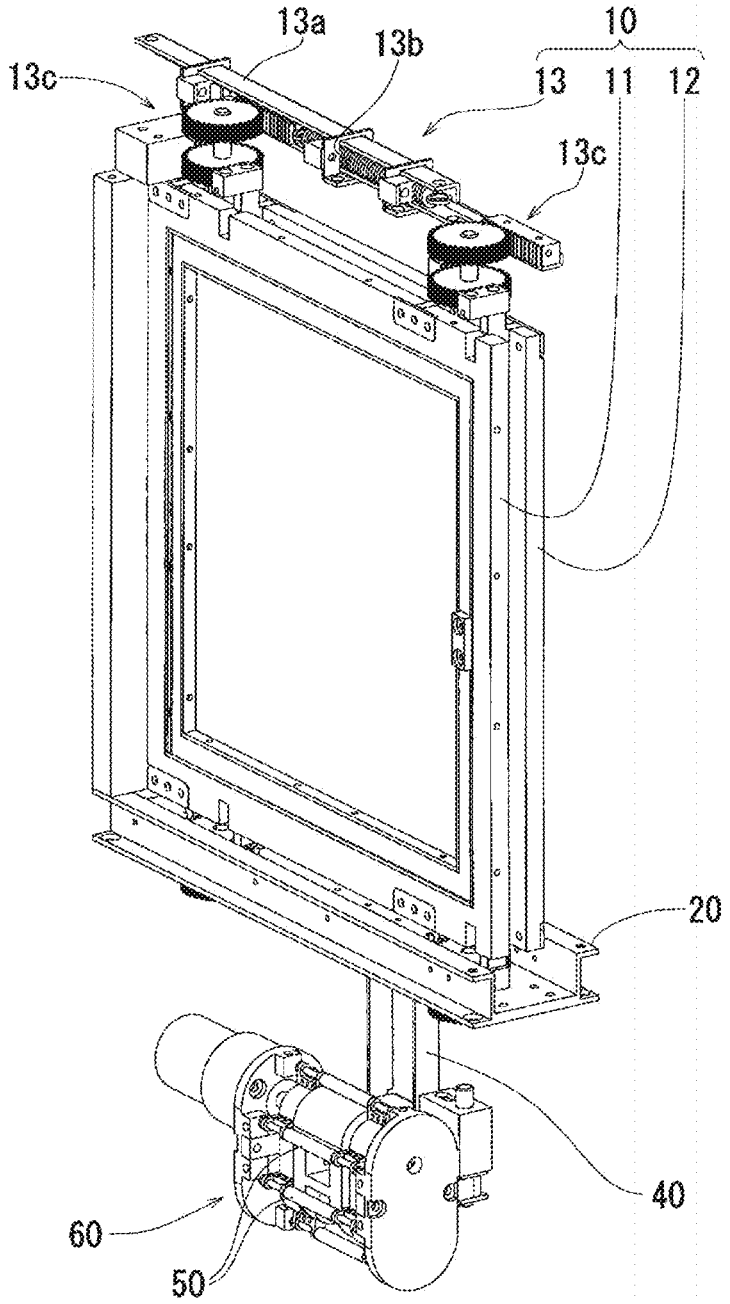
FIG. 5 is a perspective view for illustrating a state in which the pressing parts approach each other in the discharge device according to the first embodiment of the present invention.
Figure 6:
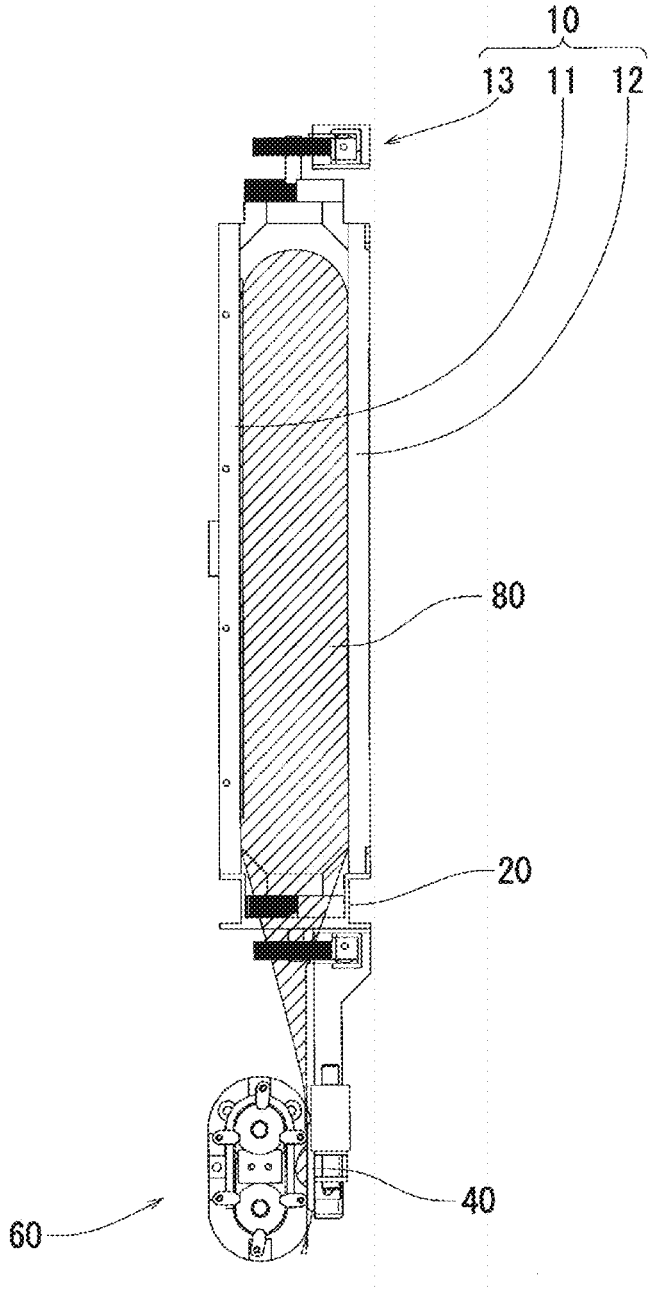
FIG. 6 is a view for illustrating a state in which a flexible container is weakly pressed by the pressing parts in the discharge device according to the first embodiment of the present invention.
Figure 7:
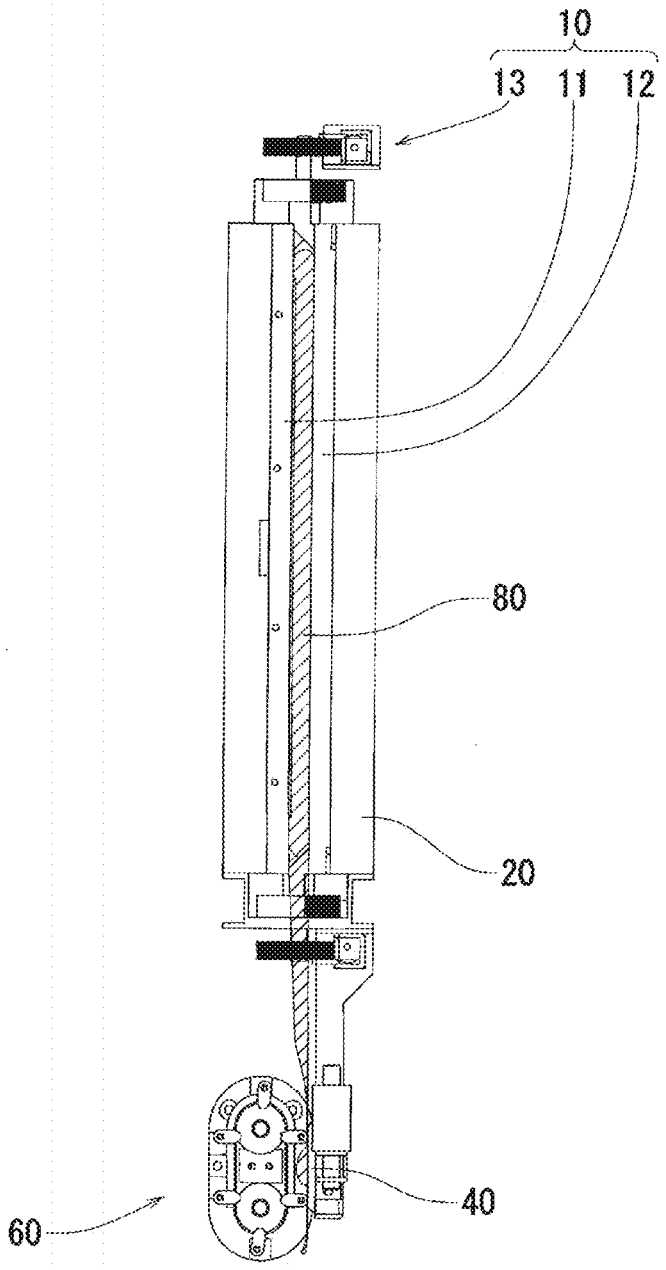
FIG. 7 is a view for illustrating a state in which the flexible container is strongly pressed by the pressing parts in the discharge device according to the first embodiment of the present invention.
Figure 8:
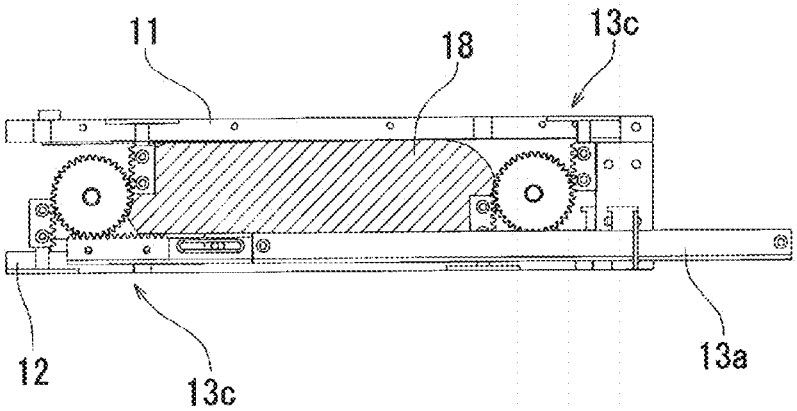
FIG. 8 is a view for illustrating an arrangement of a drive mechanism unit in a state where a container storage device is not stored in a storage shelf in the discharge device according to the first embodiment of the present invention.
Figure 9:
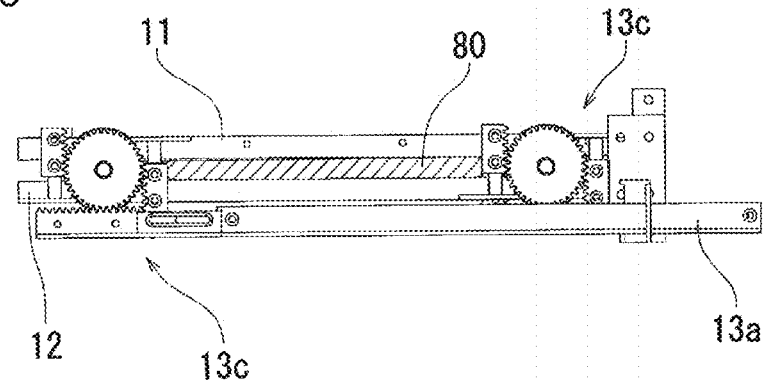
FIG. 9 is a view for illustrating an arrangement of the drive mechanism unit in a state where the container storage device is stored in the storage shelf in the discharge device according to the first embodiment of the present invention.
Figure 10:
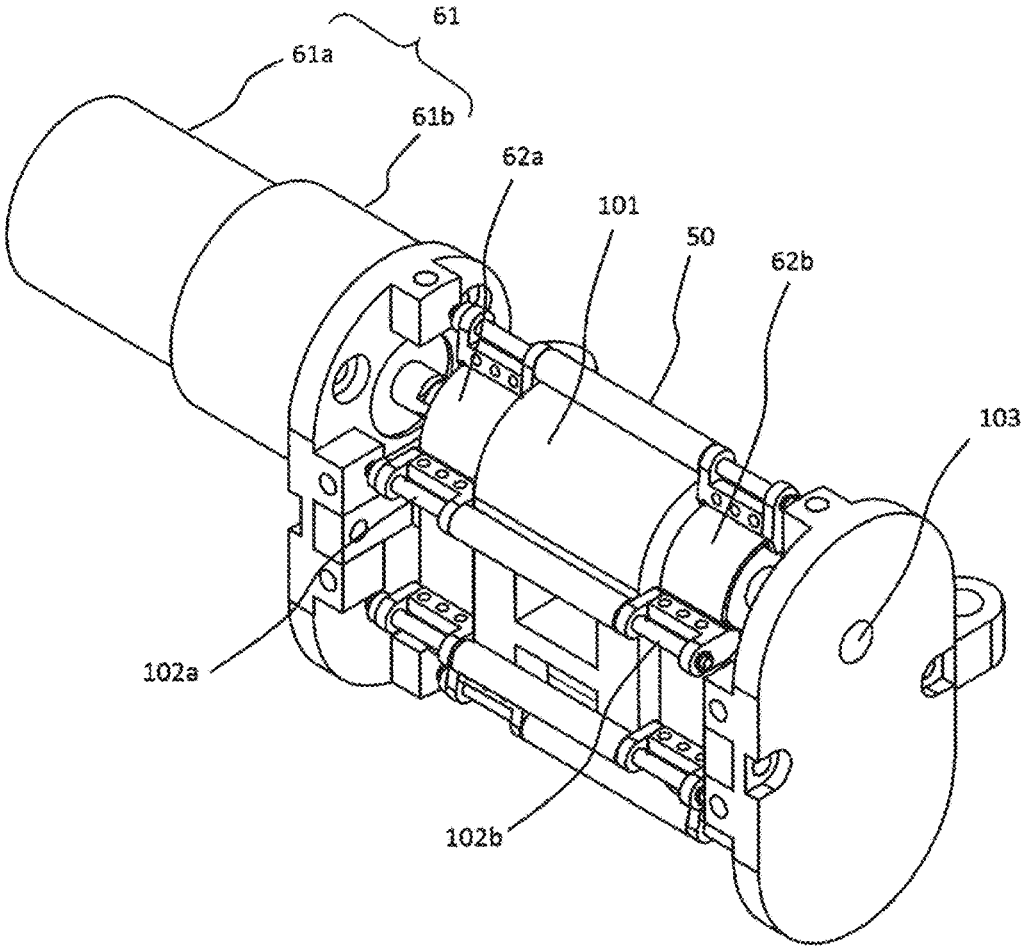
FIG. 10 is an overall perspective view for illustrating a structure of an endless transfer mechanism unit in the discharge device according to the first embodiment of the present invention.
Figure 11:
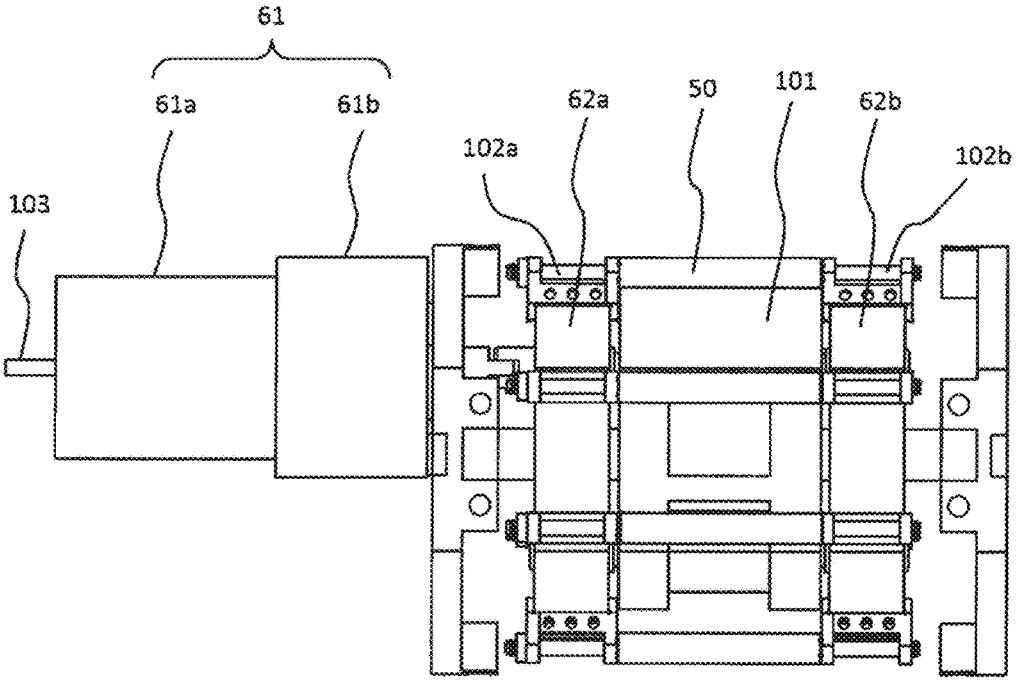
FIG. 11 is a front view for illustrating the structure of the endless transfer mechanism unit in the discharge device according to the first embodiment of the present invention.

Hereinafter, a discharge device according to a first embodiment of the present invention will be described with reference to FIGS. 1 to 16. In the present embodiment, an example of a discharge device which is used to provide a plurality of types of beverages by storing a plurality of flexible containers each filled with and sealing a drinking raw material liquid as a content of the flexible container will be described.

In the respective figures, a discharge device 1 according to the present embodiment is configured to include: an extrusion mechanism unit 10 that holds a flexible container 80 from the side and presses the flexible container 80; a support frame 20 that supports the flexible container 80 in a state capable of being pressed by the extrusion mechanism unit 10; a storage shelf 30 that allows the support frame 20 in a state of supporting the flexible container 80 to be taken in and out in a predetermined direction; a pressure receiving part 40 that has a flat part extending along a discharge passage part 81 provided at the end of the flexible container 80 held by the extrusion mechanism unit 10; a plurality of roller parts 50 that are disposed on an opposite side of the discharge passage part 81 of the flexible container 80 from the pressure receiving part 40 and press the discharge passage part 81 from the side to push the discharge passage part 81 against the pressure receiving part 40; and an endless transfer mechanism unit 60 that has the plurality of roller parts 50 attached at a predetermined interval and causes the roller parts 50 to go around on a predetermined path.

Note that the flexible container 80 handled by the discharge device 1 according to the present embodiment is a deformable container that has a bag wall formed of a flexible sheet body and is filled with a content having the property of fluidity. In particular, the flexible container 80 is formed with a reservoir part 82 that constantly reserves the content and a discharge passage part 81 for taking out the content that communicates with the reservoir part 82, and comprises a part in which an elongated gap is formed between two overlapping bag walls at the end of the flexible container.

The extrusion mechanism unit 10 holds the flexible container 80 filled with the content having the property of fluidity from the side and presses the flexible container 80 to apply a pressure to the content in the flexible container 80 to move toward the discharge passage part 81.

Particularly, the extrusion mechanism unit 10 is configured to include: a pair of pressing parts 11, 12 that are arranged on opposite sides of the flexible container 80 and are disposed capably of approaching and separating from the flexible container 80; and a drive mechanism unit 13 that moves these pressing parts 11, 12 in a direction to approach the flexible container 80.

The pressing parts 11, 12 are substantially plate-like bodies formed to have a size that can press almost the whole of the flexible container 80. Of these, one pressing part 11 is provided with an openable and closable door part 11*a* for taking in and out of the flexible container 80 with respect to the support frame 20.

The support frame 20 is formed as a rectangular (or square) frame-shaped body formed by combining each frame side in a direction perpendicular to a pressing direction of the pressing parts 11, 12 of the extrusion mechanism unit 10. The support frame 20 is also configured to have the extrusion mechanism unit 10, the pressure receiving part 40, and the endless transfer mechanism unit 60 integrally attached thereto and to support the flexible container 80 as a state capable of being pressed by the pressing parts 11, 12 of the extrusion mechanism unit 10.

The support frame 20 has a frame-shaped structure so as to surround the pressing parts 11, 12 and the flexible container 80 by each frame side in a direction perpendicular to a pressing direction of the pressing parts 11, 12 and to make a dimension in the direction perpendicular to the pressing direction of the pressing parts 11, 12 larger than a dimension in a direction parallel to the pressing direction of the pressing parts 11, 12.

The support of the flexible container 80 by the support frame 20 is not limited to supporting the flexible container 80 only by placing the flexible container 80 on a lower side of the support frame 20 but may also be possible to suspend and support the flexible container 80 by hanging an upper part of the flexible container 80 over a predetermined part of an upper side of the support frame 20.

In contrast to the support frame 20, the flexible container 80 is formed as such a bag shape that allows the flexible container 80 to make a dimension in the direction perpendicular to the pressing direction of the pressing parts 11, 12 larger than a dimension in a direction parallel to the pressing direction of the pressing parts 11, 12 and to be entirely fitted inside the support frame 20, except for the discharge passage part 81, even when the flexible container 80 is fully filled with the content, in a state where the flexible container 80 is supported by the support frame 20.

The discharge passage part 81 of the flexible container 80 has an arrangement so as to be drawn out to below the support frame 20 through a through hole provided in the lower side of the support frame 20 in a state where the flexible container 80 is supported by the support frame 20.

The storage shelf 30 is formed into a substantially box shape and is configured such that the support frame 20 with the flexible container being supported thereby can be taken in and out in a predetermined direction together with the extrusion mechanism unit 10, the pressure receiving part 40, and the endless transfer mechanism unit 60 and can be stored capably of taking out the content to the outside from the discharge passage part 81 of the flexible container 80.

The storage shelf 30 is enabled to store a plurality of the support frames 20 in a state where the support frames 20 are taken in and out in the direction perpendicular to the pressing direction of the pressing parts 11, 20 of the extrusion mechanism unit 10 and are arranged in the direction parallel to the pressing direction of the pressing parts 11, 20 at a predetermined arrangement pitch.

The storage shelf 30 is configured to include a plurality of rail parts 31 that are disposed so as to be extensible in a direction to take the support frame 20 in and out and that can support the support frame 20 that is pulled out from the storage shelf 30 with the plurality of rail parts 31 respectively engaged with a plurality of upper and lower parts of the support frame 20.

Further, there is provided a mechanism in which the drive mechanism unit 13 of the extrusion mechanism unit 10 generates a driving force for moving the pressing parts 11, 12 when the support frame 20 is put into a storing section of the storage shelf 30.

Particularly, the drive mechanism unit 13 is configured to include: a movable piece 13*a* that is movably attached to the support frame 20 and moves relative to the support frame 20 by being pushed relatively from the storage shelf 30 side when the support frame 20 is pushed into the storing section of the storage shelf 30; a spring 13*b* that is attached to the movable piece 13*a* at one end of the spring 13*b* and generates a biasing force in a direction to bring the other end of the spring 13*b* close to the one end of the spring 13*b* as the movable piece 13*a* moves relative to the support frame 20 together with the one end of the spring 13*b;* and a transmission mechanism part 13*c* that is comprised of a combination of a rack and a pinion and that is supported by the support frame 20 in a movable state and is attached to the other end of the spring 13*b,* adapted to transmit the biasing force of the spring 13*b* to the pressing parts 11, 12 while being displaced by the biasing force from the spring 13*b* to move the pressing parts 11, 12.

The pressure receiving part 40 is formed of a member attached to a lower part of the support frame 20 in a protruding state and is configured to have, at an end of the member, a flat part of a predetermined size parallel to the direction perpendicular to the pressing direction of the pressing parts 11, 12. This flat part is arranged just along the discharge passage part 81 at the end in the flexible container 80 that is in a state of being held by the pair of pressing parts 11, 12 of the extrusion mechanism unit 10.

In the present embodiment, the endless transfer mechanism unit 60 is attached below the support frame 20 by a connection mechanism through the pressure receiving part 40. This endless transfer mechanism unit 60 includes: a guide part 101 that is disposed from a surface of the pressure receiving part 40 with a gap having a size at least larger than a roller diameter of the roller part 50 and guides the go-around movement of the roller parts 50 along an inner side of the respective roller part 50; a pair of endless belt 62*a,* 62*b* that are disposed on both sides of the guide part 101 to be bilaterally symmetrical and to be in a state capable of circulating with driven by a motor 61 in the same direction as a guide direction of the guide part 101; and roller supports 102*a,* 102*b* that are disposed on the surfaces of the endless belts 62*a,* 62*b* and support the plurality of roller parts 50 at a predetermined interval (see FIGS. 10 to 12).

The roller parts 50 are supported by the pair of roller supports 102*a,* 102*b* so as to be perpendicular to the guide direction of the guide part 101, that is, a circulation direction of the guide part 101. The roller parts 50 are also supported by the roller supports 102*a,* 102*b* so as to slide along a surface of the guide part 101 in order to suppress deformation due to pressure of the roller parts 50. As described above, the roller parts 50 go around in a state where the roller parts 50 are supported by the roller supports 102*a,* 102*b* fixed to the surfaces of the endless belts 62*a,* 62*b,* so that it is possible to improve a dimension of each roller part 50 and a degree of freedom in layout.

A drive shaft 103 is rotated with a motor 61 comprised of a motor main body 61*a* and a gear part 61*b* driven, and by this rotation of the drive shaft 103 the endless belts 62*a,* 62*b,* which cover the drive shaft 103, and a driven shaft 104 are rotated. Then, the roller parts 50 can slide in the guide direction of the guide part 101 through the roller supports 102*a,* 102*b* disposed on the surfaces of the endless belts 62*a,* 62*b.*

The plurality of the roller parts 50 are disposed on an opposite side of the discharge passage part 81 of the flexible container 80 from the pressure receiving part 40*n,* and press the discharge passage part 81 of the flexible container 80 from the side while moving around along the guide part 101, to push the discharge passage part 81 against the pressure receiving part 40 until the discharge passage part 81 is occluded at a pressing position.

Each roller part 50 linearly moves sequentially in a direction moving away from the extrusion mechanism unit 10 while pressing the discharge passage part 81, to send out the content in the discharge passage part 81 to the outside.

The direction in which each roller parts 50 presses the discharge passage part 81 of the flexible container 80 to push the discharge passage part 81 against the pressure receiving part 40 is parallel to the pressing direction of the pressing parts 11, 12.

The endless transfer mechanism unit 60 is configured to have an arrangement including, in the path of the above go-around movement, a straight-line portion in which the roller parts 50 linearly move in an extending direction of the discharge path part 81 of the flexible container 80. In this endless transfer mechanism unit 60, an attachment interval of the plurality of roller parts 50 is set to such an interval that before a certain roller part 50 moving around reaches a position where the certain roller part 50 does not press the discharge path part 81, a subsequent roller part 50 can reach a position where the subsequent roller part 50 presses the discharge path part 81 (see FIG. 13).

A part of the endless transfer mechanism unit 60, appearing on the surface thereof, opposite to the side facing the pressure receiving part 40, is provided with a cover 63 that covers said part to prevent a person from accidentally coming into contact with movable parts such as the endless belt 62 and the roller parts 50.

The total dimension of the endless transfer mechanism unit 60 and the pressure receiving part 40 in the direction parallel to the pressing direction of the pressing parts 11 and 12 is less than the arrangement pitch of the support frame 20 in the storage shelf 30.

Figure 14:
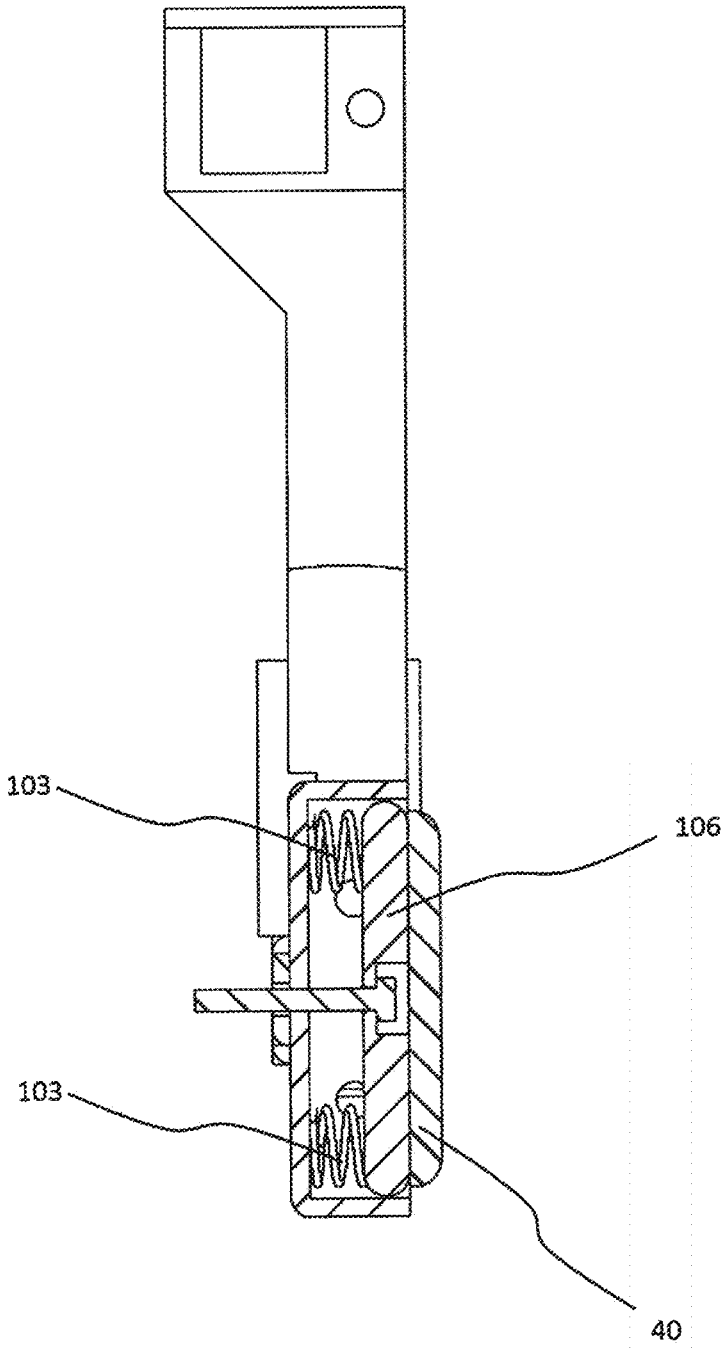
FIG. 14 is a first view for illustrating a pressure receiving part in the discharge device according to the first embodiment of the present invention.

In addition, there is a case where the endless transfer mechanism unit 60 is tilted with respect to the pressure receiving part 40 depending on a state and/or thickness of the discharge passage part 81, and it is possible in some cases that the roller parts 50 cannot equally press the discharge passage part 81 when the roller parts 50 press the discharge passage part 81. Thus, in this case, the roller parts 50 cannot properly press the discharge passage part 81, so that there is a possibility that it is not possible to discharge a predetermined amount of liquid. In order to prevent such a problem, an elastic body having an elastic force opposite to a pressing force in a pressing direction of the roller parts 50 may be provided on a rear surface side of the pressure receiving part 40, as shown in FIG. 14. With such a configuration, even if the discharge operation is driven in a state where the endless transfer mechanism unit 60 is tilted with respect to the pressure receiving part 40, it is possible to make the pressing force of the roller parts 50 uniform by the elastic force of the elastic body 105 to discharge a proper amount of liquid.

Further, in FIG. 14, there is provided a pressure support 106 for restricting directions of the pressing force received by the pressure receiving part 40 and the elastic force by the elastic body 105, and it is structured such that the pressure receiving part 40 receives the elastic force from the elastic body 105 through the pressure support 106.

Figure 15:
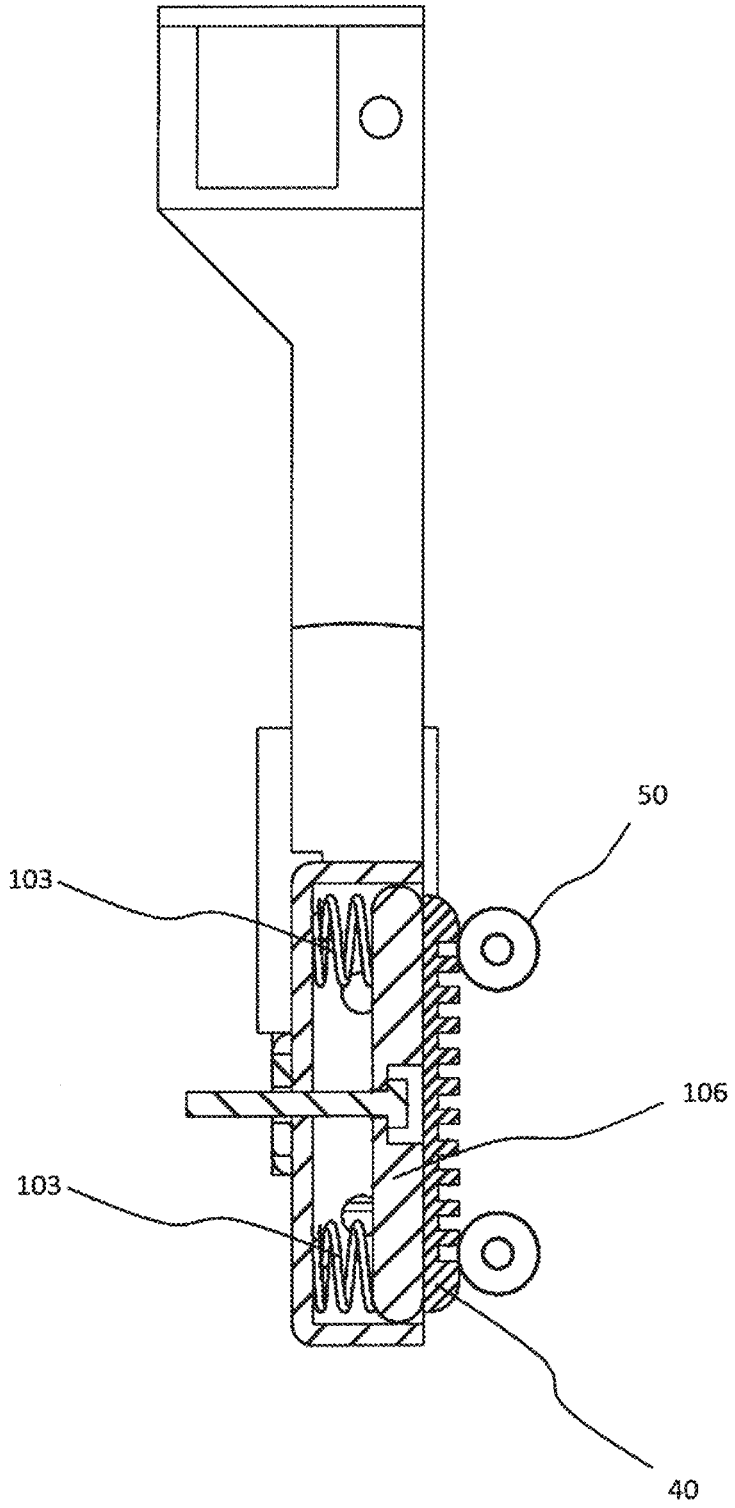
FIG. 15 is a second view for illustrating the pressure receiving part in the discharge device according to the first embodiment of the present invention.
Figure 16:
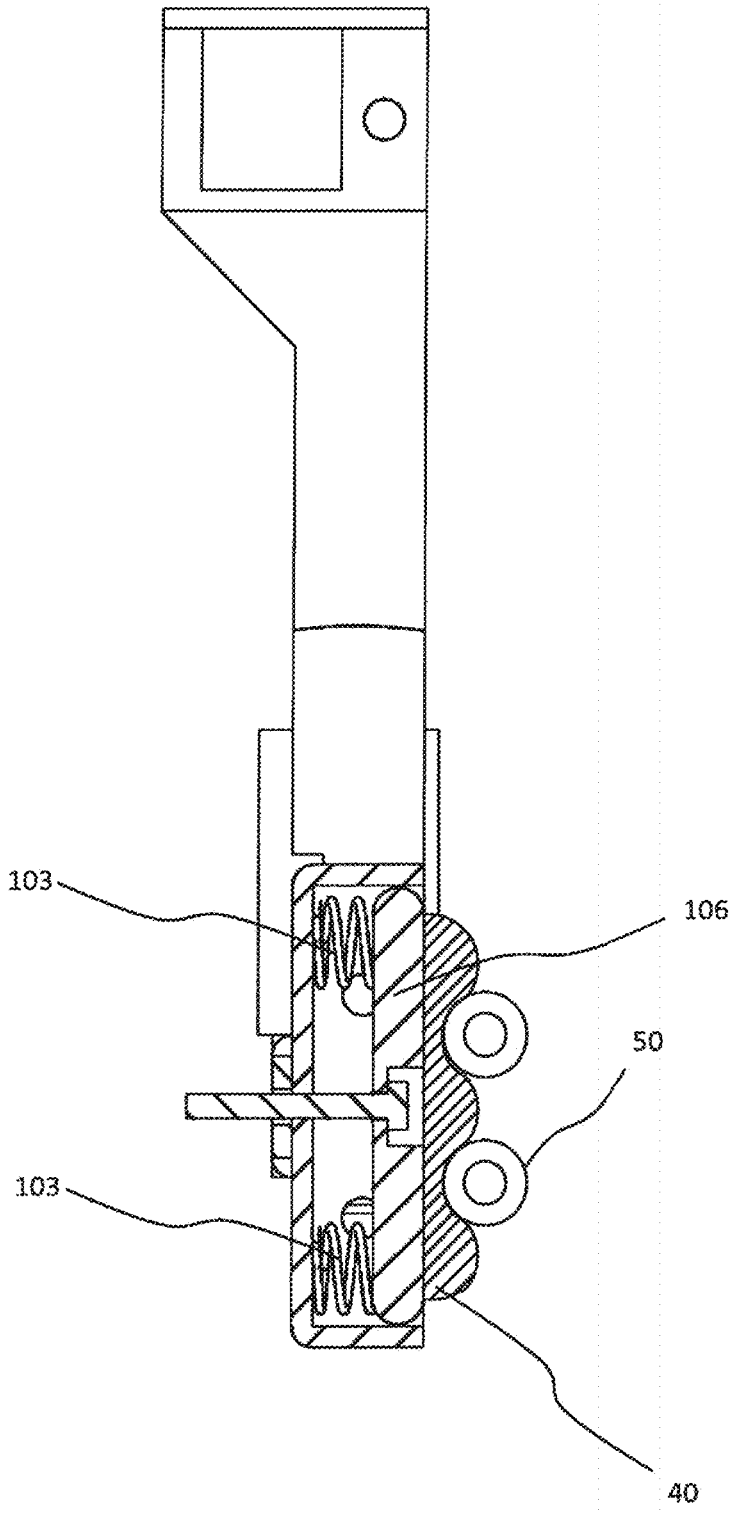
FIG. 16 is a third view for illustrating the pressure receiving part in the discharge device according to the first embodiment of the present invention.

Further, in order to more reliably and stably press the discharge passage part 81, the surface of the pressure receiving part 40 may be processed, as shown in FIGS. 15 and 16. In FIG. 15, the surface of the pressure receiving part 40 is processed into a recess groove shape, and it is structured such that the discharge passage part 81 pressed by the roller parts 50 is in contact and pressed at a plurality of parts on the pressure receiving part 40 side. With such a structure, stress concentrates on edge portions of the recess groove shape, and the discharge passage part 81 is pressed more firmly, so that it is possible to prevent the liquid within the discharge passage part 81 of the flexible container 80 from leaking out from the discharge passage part 81 when the endless transfer mechanism unit 60 is stopped, and it is also possible to reliably squeeze out the liquid within the discharge passage part 81 while the endless transfer mechanism unit 60 is under circulation movement. In this case, it is desirable that a groove width of the recess groove shape is less than the diameter of the roller part 50 and ¼ or more of the diameter of the roller part 50.

Figure 12:
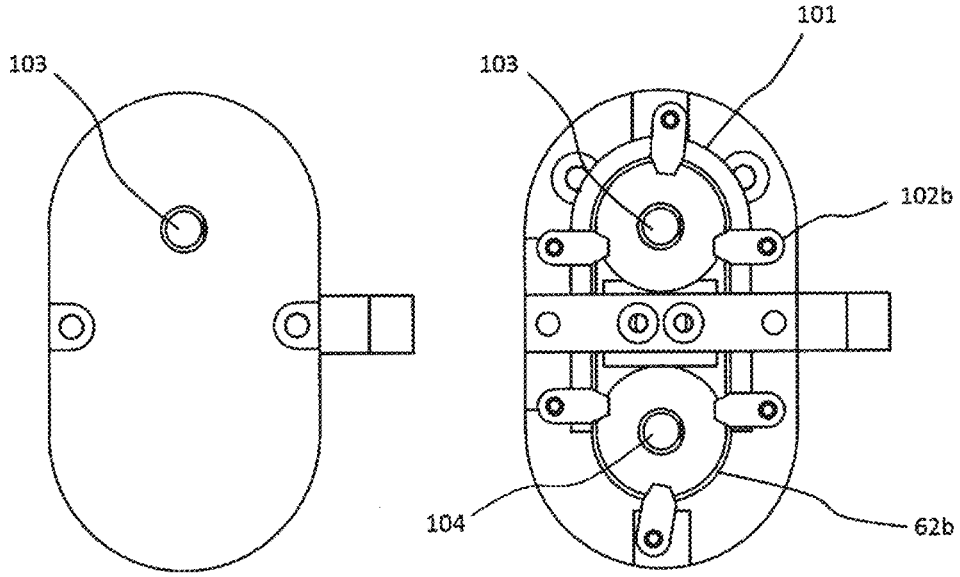
FIG. 12 is a side view for illustrating the structure of the endless transfer mechanism unit in the discharge device according to the first embodiment of the present invention.
Figure 13:
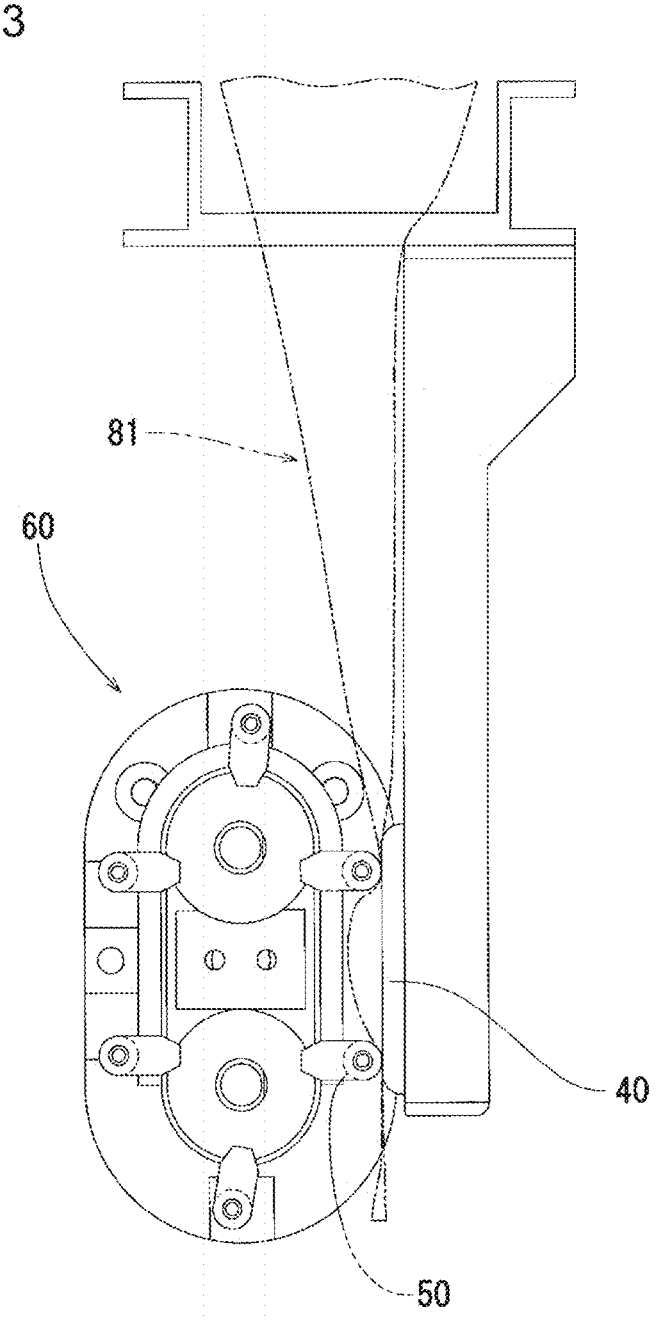
FIG. 13 is a view for illustrating a state in which a discharge passage part is pressed by roller parts in the discharge device according to the first embodiment of the present invention.

Furthermore, in FIG. 16, the surface of the pressure receiving part 40 is processed into a wave shape in conformity with an arc of the roller part 50, and it is structured such that the roller parts 50 press the discharge passage part 81 in a wide range (increasing a contact and pressure area between the roller parts 50 and the discharge passage part 81) compared to the case where the pressure receiving part 40 has a smooth surface as shown in FIG. 12. With such a structure, the pressing force is strengthened or weakened according to the wave shape on the surface of the pressure receiving part 40 while pressing the discharge passage part 81 in the wide range, so that it is possible to prevent the liquid within the discharge passage part 81 of the flexible container 80 from leaking out from the discharge passage part 81 when the endless transfer mechanism unit 60 is stopped, and it is also possible to reliably squeeze out the liquid within the discharge passage part 81 while the endless transfer mechanism unit 60 is under circulation movement.

The endless transfer mechanism unit 60 is disposed to be tiltable with respect to the pressure receiving part 40 and there is provided a mechanism in which the discharge passage part 81 of the flexible container 80 can be held between the pressure receiving part 40 and the endless transfer mechanism unit 60 by tilting the endless transfer mechanism unit 60 with respect to the pressure receiving part 40 together with each roller part 50 and temporarily moving the endless transfer mechanism unit 60 to a position where the endless transfer mechanism unit 60 does not overlap with the flat part of the pressure receiving part 40.

In a case where the endless transfer mechanism unit 60 is configured to be disposed tiltably toward the side to approach the storage shelf 30 with the support frame 20 pulled out from the storage shelf 30 when the endless transfer mechanism unit 60 is tilted with respect to the pressure receiving part 40, a state in which the flat part of the pressure receiving part 40 is opened on the side closer to an operator is obtained, resulting in that it is possible to improve the efficiency of operations such as holding the discharge passage part 81 between the pressure receiving part 40 and the endless transfer mechanism unit 60 and, reversely, removing the discharge passage part 81 from such a held state.

Next, the process of storing and removing the flexible container in the discharge device according to the present embodiment, and the state in which the content is poured from the flexible container, will be described.

First, the support frame 20 is pulled out from the storage shelf 30 to a position where the door part 11 a of the pressing part 11 can be opened and closed, and subsequently the door part 11*a* is opened to put the flexible container 80 in a fully filled state into the support frame 20. Then, the discharge passage part 81 of the flexible container 80 is drawn out to below the support frame 20 through the through hole provided in the lower side of the support frame 20.

After the flexible container 80 is put into the support frame 20 and the flexible container 80 is supported with the support frame 20, the door part 11*a* is closed to make the flexible container 80 in a state capable of being held and pressed by the pressing part 11 including this door part 11*a* and the other pressing part 12 that holds the container 80.

In addition, with regard to the discharge passage part 81 of the flexible container 80 drawn out to below the support frame 20, the endless transfer mechanism unit 60 below the support frame 20 is tilted with respect to the pressure receiving part 40 and moved to the position where the endless transfer mechanism unit 60 does not overlap with the flat part of the pressure receiving part 40, and then the discharge passage part 81 is disposed along the flat part of the pressure receiving part 40 and the endless transfer mechanism unit 60 is put back into its original state, thereby leaving in a state where the discharge path part 81 is held between the pressure receiving part 40 and the endless transfer mechanism unit 60 and the discharge path part 81 is pressed by any of the roller parts 50 to be pushed against the pressure receiving part 40.

After this, the support frame 20 is pushed into the storing section of the storage shelf 30 to store the support frame 20 in the storage shelf 30. When the support frame 20 is pushed into the storing section of the storage shelf 30, the drive mechanism unit 13 of the extrusion mechanism unit 10 generates the driving force for moving the pressing parts 11, 12. Specifically, with the support frame 20 being pushed into the storing section of the storage shelf 30, the movable piece 13*a* is pushed relatively from the storage shelf 30 side to move relative to the support frame 20, and one end of the spring 13*b*, attached to the movable piece 13*a*, also moves relative to the support frame 20 to extend the spring 13*b*, so that the spring 13*b* generates the biasing force in the direction to bring the other end of the spring 13*b* close to the one end of the spring 13*b*. The transmission mechanism part 13*c* to which the other end of the spring 13*b* is attached transmits the biasing force of the spring 13*b* to the pressing parts 11, 12 while being displaced by the biasing force from the spring 13*b*, to move the respective pressing parts 11, 12 in a direction to press the flexible container 80.

In this manner, the flexible container 80, which is now in a state being stored in the storage shelf 30 together with the support frame 20, is pressed by the pressing parts 11, 12 and maintained in a state where the content is directed toward the discharge passage part 81.

Although the flexible container 80 is pressed by the pressing parts 11, 12 based on the biasing force from the spring 13*b*, a reaction force against the pressing occurs relatively while the content is in the container, so that the pressing parts 11, 12 cannot be completely displaced to their movable limit and stop halfway, resulting in a state where the pressing force continues to be applied to the flexible container 80.

In a case where the content is poured out from the flexible container 80 and the flexible container 80 is replaced with a new one, the support frame 20 is pulled out from the storing section of the storage shelf 30 and the support frame 20 is moved to a position where the door part 11*a* can be opened and closed. At this time, the state in which the movable piece 13*a* is pushed relatively from the storage shelf 30 side is also released, so that the movable piece 13*a* moves relative to the support frame 20 by the biasing force of the spring 13*b* and returns to the original position, and at the same time the transmission mechanism part 13*c* is also displaced to the original state and the pressing parts 11, 12 are put back into a position before the flexible container 80 is pressed.

In a state where the support frame 20 is in the position where the door part 11*a* can be opened and closed, the endless transfer mechanism unit 60 below the support frame 20 is first tilted with respect to the pressure receiving part 40 and then moved to the position where the endless transfer mechanism unit 60 does not overlap with the flat part of the pressure receiving part 40. Subsequently, the discharge passage part 81 of the flexible container 80 is separated from the flat part of the pressure receiving part 40 to make a state in which the discharge passage part 81 is removed from between the pressure receiving part 40 and the endless transfer mechanism unit 60. Thereafter, the door part 11*a* is opened to take out, from within the support frame 20, the flexible container 80 after the content has been discharged, and another flexible container 80 in a fully filled state is newly put into the support frame 20 while its discharge passage part 81 is drawn out to below the support frame 20.

After this, the same procedure as described above is repeated. The door part 11*a* is closed, and the discharge passage part 81 drawn out to below the support frame 20 is put in the state of being held between the pressure receiving part 40 and the endless transfer mechanism unit 60, and then the support frame 20 is pushed into the storing section of the storage shelf 30 to store the support frame 20 in the storage shelf 30, resulting in the completion of exchange.

Subsequently, a discharge operation state of the discharge device 1 will be described. The flexible container 80 that is pressed by the pressing parts 11, 12 of the extrusion mechanism unit 10 in the state where the flexible container 80 is stored in the storage shelf 30 per support frame 20 is in a state where the pressure to move toward the discharge passage part 81 is applied to the content having the property of fluidity within the flexible container 80.

When a command to discharge a content of the flexible container 80 is issued by a user's operation, the endless transfer mechanism unit 60 attached to the lower part of the support frame 20 is operated under the control of a predetermined control unit (not shown), and the circulation movement of the endless belt 62 causes the plurality of roller parts 50 attached at the predetermined interval to move and perform the go-around movement.

On the side, facing the discharge passage part 80, of the endless transfer mechanism unit 60, each roller part 50 linearly moves sequentially in a direction moving away from the extrusion mechanism unit 10 while pressing the discharge passage part 81 to push the discharge passage part 81 against the flat part of the pressure receiving part 40. With the movement of a part where the discharge passage part 81 is pressed by the roller part 50, the discharge passage part 81 expanded with an inflow of the content is put into a state of being sequentially squeezed by the roller parts 50, and the content that has flown into the discharge passage part 81 is advanced little by little in the discharge passage part 81 in accordance with the linear movement of the roller part 50 and is finally sent out from an open end of the discharge passage part 81 to the outside. In this way, the content can be discharged from the flexible container 80 through the discharge passage part 81.

By such a state that the flexible container 80 is continuously held and pressed by the pressing parts 11, 12, the content receiving a pressure continues to flow into the discharge passage part 81, so that the contents also continues to be discharged while the endless transfer mechanism unit 60 is operated and the roller parts 50 linearly move with pressing the discharge passage part 81. When a proper amount of content is discharged, the operation of the endless transfer mechanism unit 60 is stopped by the control, and one discharge operation is completed.

In the discharge passage part 81, a content within the discharge passage part 81 in the range from its open end to a pressing position of the roller part 50 closest to that open end comes out, whereas a content in the range from the pressing position of the roller part 50 closest to that open end to a position closer to the extrusion mechanism unit 10 is prevented from passing through the pressing position by close contact between the bag walls due to the pressing of the roller part 50 and does not go out from the discharge passage part 81 to the outside. Therefore, it is possible to discharge a proper amount of content by adjusting a state of movement of the roller parts 50 with respect to the discharge passage part 81.

The endless transfer mechanism unit 60 can obtain an amount of movement of the endless belt 62 and the roller parts 50 by an encoder or the like and can accurately position the roller parts 50, so that it is possible to move the endless transfer mechanism unit 60 to a proper position based on the control to discharge a set proper amount of content and it is also possible to make it difficult for the content to remain in the end of the discharge passage part 81 to prevent dripping.

Further, in a case where the discharge passage part 81 is pressed against the pressure receiving part 40 by the roller parts 50 to bring the bag walls forming the discharge passage part 81 into close contact with each other in the vicinity of the end of the discharge passage part 81, and then, in this state, the discharge is once ended and the endless transfer mechanism unit 60 is stopped, an occluded state is obtained in which outside air and the content are not brought into contact with each other in the discharge path part 81, so that it is possible to secure the occluded state to maintain a sanitary condition of the discharge passage part 81 during the time of non-discharging, without using another mechanism such as a conventional pinch mechanism.

As described above, in the discharge device according to the present embodiment, in order to discharge the content from the flexible container 80, the flexible container 80 filled with the content is held and pressed by the extrusion mechanism unit 10 to keep applying to the content in the flexible container 80 the pressure to move toward the discharge passage part 81, and also the discharge passage part 81 of the flexible container 80 is pressed by the roller parts 50 while the roller parts 50 are linearly moved with the endless transfer mechanism unit 60, to put the discharge passage part 81 expanded with the inflow of the content into the state of being sequentially squeezed by the roller parts 50, so that the content in the discharge passage part 81 is advanced little by little toward an opening of the end of discharge passage part 81 in accordance with the linear movement of the roller parts 50 and is finally sent out from the open end of the discharge passage part 81, thereby making it possible to discharge the content through the discharge passage part 81, which results in that it is possible to discharge the content with a simple mechanism. Further, the content in the range other than that from the end of the discharge passage part 81 to the position pressed by the roller part 50 cannot go out, so that it is also possible to discharge a proper amount of content by adjusting a state of movement of the roller parts 50. Furthermore, in the case where the discharge passage part 81 is constantly pressed against the pressure receiving part 40 by any of the roller parts 50 to bring the bag walls forming the discharge passage part 81 into close contact with each other, the occluded state in which the outside air and the content are not brought into contact with each other is obtained without another mechanism and it is possible to secure the sanitary condition of the discharge passage part 81.

In addition, the content can be taken out by forming a part of the flexible container 80 as the discharge passage part 81, so that it is not necessary to additionally provide the flexible container 80 with a passage part for taking out content such as a tube made of a different material and cost reduction can be also realized for containers as much as the structure of the container can be simplified.

Second Embodiment of the Present Invention

Figure 17:
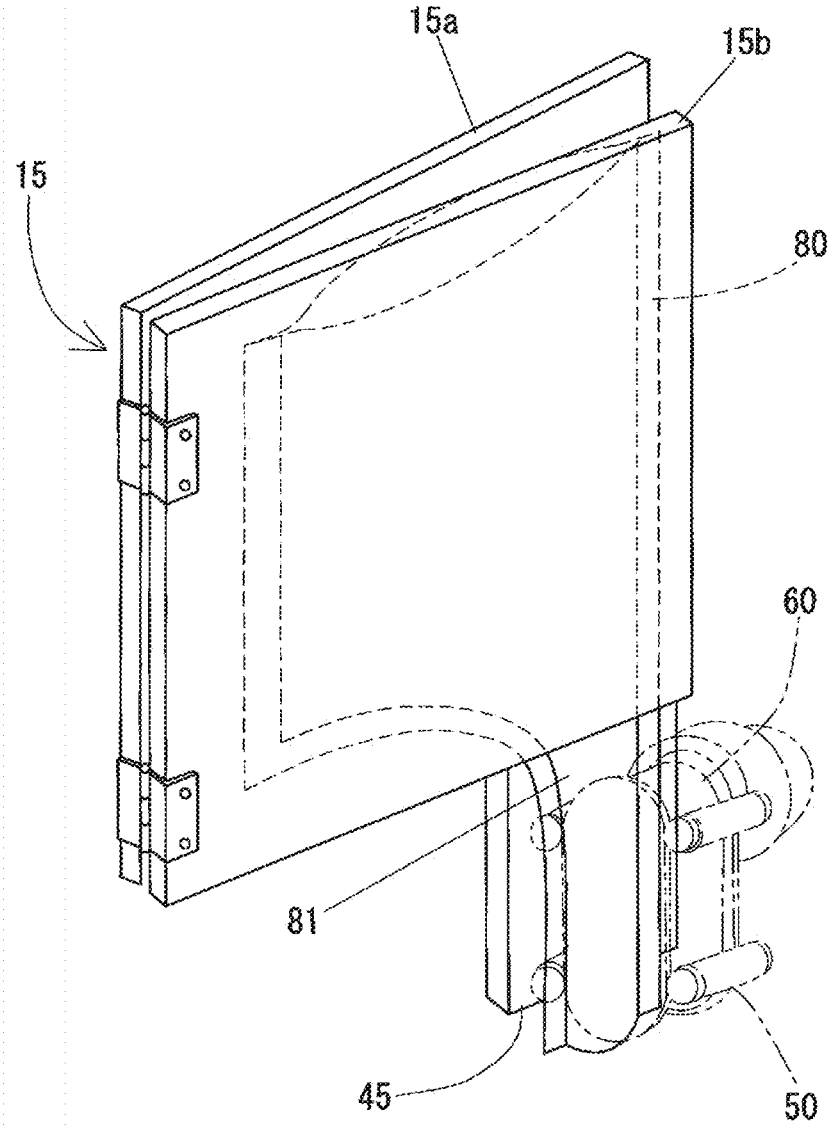
FIG. 17 is a perspective view for illustrating a state in which a flexible container is pressed by an extrusion mechanism unit in a discharge device according to a second embodiment of the present invention.
Figure 18:
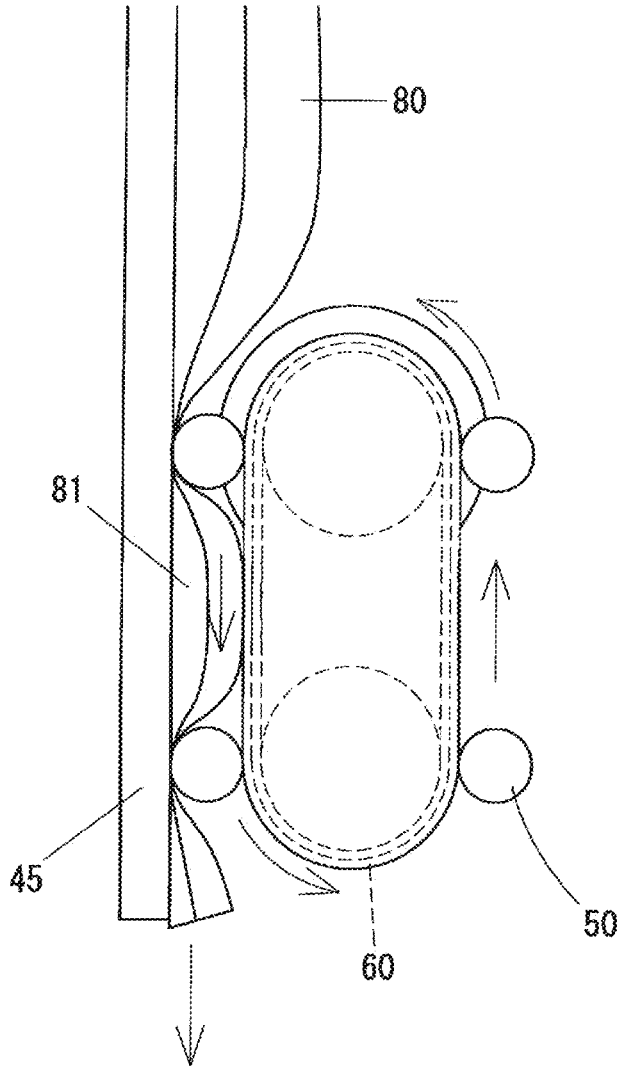
FIG. 18 is a view for illustrating a state in which a discharge passage part is pressed by roller parts in the discharge device according to the second embodiment of the present invention.

In the discharge device according to the above embodiment, the extrusion mechanism unit 10 is configured to include: the pair of pressing parts 11, 12 that are arranged by interposing the flexible container 80 and are disposed capably of approaching and separating from the flexible container 80; and the drive mechanism unit 13 that moves these pressing parts 11, 12 in the direction to approach the flexible container 80, and to linearly move the pair of pressing parts 11, 12 by the drive mechanism unit 13 to hold and press the flexible container 80. However, not limited to this, it may be possible to configure a second embodiment in which the extrusion mechanism unit 15 includes: a fixed part 15*a* that is in contact with the flexible container 80 in a fixed state where the fixed part 15*a* does not move with respect to the flexible container 80; and a movable part 15*b* that moves with respect to the fixed part 15*a*, and only the movable part 15*b* is moved to press the flexible container 80 against the fixed part 15*a* to hold the flexible container 80, as shown in FIGS. 17 and 18.

In this case, as a specific example of the extrusion mechanism unit 15, it may be configured such that the movable part 15*b* of the extrusion mechanism unit 15 is hinged to the fixed part 15*a* of the extrusion mechanism unit 15 and then a positional relationship between the flexible container 80 and the extrusion mechanism unit 15 is set in such way that the discharge passage part 81 of the flexible container 80 is positioned away from the hinged portions of the movable part 15*b* and the fixed part 15*a*, resulting in that it is possible to make a distance between the fixed part 15*a* and the movable part 15*b* in a state of holding the flexible container 80 smaller as the holding portions hold a part farther from the discharge passage part 81 of the flexible container 80, and to make the distance larger as the holding portions hold a part closer to the discharge passage part 81 of the flexible container 80, to move a content of the flexible container 80 from the farther part to the closer part with respect to the discharge passage part 81 in the flexible container 80.

As describe above, by facilitating the content to advance toward the discharge passage part 81 within the flexible container 80 when the flexible container 80 is pressed in the extrusion mechanism unit 15, it is possible to move the content of the flexible container 80 toward the discharge passage part 81 to make the content smoothly flow into the discharge passage part 81, resulting in that the content of the flexible container 80 can be reliably discharged through the discharge passage part 81 to the last and can be used without waste. Further, a state in which the content moves toward the discharge passage part 81 within the flexible container 80 can be realized by such a simple mechanism that the movable part 15*b* is hinged to the fixed part 15*a* and only the movable part 15*b* is moved to press the flexible container 80, resulting in that cost reduction of the device can be realized.

Providing another mechanism in which the pressure receiving part 45 is arranged by extending a part of the fixed part 15*a* of the extrusion mechanism unit 15 along the discharge passage part 81 of the flexible container 80 in a held state, it is also possible to simplify the mechanism related to the pressing of the discharge passage part 81 by the roller parts 50 and the endless transfer mechanism unit 60.

REFERENCE SIGNS LIST

1 Liquid dispenser device
10, 15 Extrusion mechanism unit
11, 12 Pressing part
11*a* Door part
13 Drive mechanism unit
13*a* Movable piece
13*b* Spring
13*c* Transmission mechanism part
15*a* Fixed part
15*b* Movable part
20 Support frame
30 Storage shelf
31 Rail part
40, 45 Pressure receiving part
50 Roller part
60 Endless transfer mechanism unit
61 Motor
62 Endless belt
63 Cover part
80 Flexible container
81 Discharge passage part
82 Reservoir part
101 Guide part
102 Roller support
103 Drive shaft
104 Driven shaft
105 Elastic body
106 Pressure support

The invention claimed is:

1. A liquid dispenser that discharges a liquid from a flexible container in which the liquid is sealed, by a discharge pump for discharging the liquid from the flexible container in which the liquid is sealed, the liquid dispenser comprising:

a pressure receiving part that is disposed on an opposite side of the flexible container from the discharge pump, and a container storage part that stores the flexible container, the container storage part being stored in the liquid dispenser, wherein the flexible container comprises:

a reservoir part that reserves the liquid and a discharge passage part that communicates with the reservoir part to take out the liquid, wherein the discharge pump comprises:

a plurality of roller parts that press the discharge passage part; and an endless transfer mechanism unit that has the plurality of roller parts attached at a predetermined interval from each other and moves the roller parts to cause the roller parts to go around, wherein:

the endless transfer mechanism unit has an arrangement including a straight-line portion in which the roller parts linearly move, in a path of the go-around movement, the predetermined interval is set to such an interval that before a certain roller part reaches a position where the certain roller part does not press the discharge passage part, a subsequent roller part is able to reach a position where the subsequent roller part presses the discharge passage part, each of the roller parts linearly moves sequentially in a discharge direction of the liquid with respect to the discharge passage part while pressing the discharge passage part, the pressure receiving part and the discharge pump are provided below the container storage part, and a total dimension of the pressure receiving part and the discharge pump in a pressing direction is smaller than a width of the container storage part.

2. The discharge pump according to claim 1, wherein the flexible container is formed by sticking two sheets to each other with one side of the respective sheets extended in an elongated shape, and the discharge passage part is comprised of the elongated extended part.

3. The discharge pump according to claim 1, further comprising:

a guide part that guides the go-around movement of the roller parts;

a belt part that is disposed on both sides of the guide part to be bilaterally symmetrical and to be in a state capable of circulating in the same direction as a guide direction of the guide part; and a support that is supported on a surface of the belt part such that the roller parts are perpendicular to the guide direction and go around along a surface of the guide part.

4. The liquid dispenser according to claim 1, further comprising:

a connection mechanism that connects the pressure receiving part and the discharge pump.

5. The liquid dispenser according to claim 1, further comprising:

an elastic body that has an elastic force opposite to a pressing force in the pressing direction on a rear surface side of the pressure receiving part.

* * * * *